US006398908B1

(12) United States Patent
Hermansson et al.

(10) Patent No.: US 6,398,908 B1
(45) Date of Patent: Jun. 4, 2002

(54) PROCESS FOR ACID BLEACHING OF LIGNOCELLULOSE-CONTAINING PULP WITH A MAGNESIUM COMPOUND

(75) Inventors: Wenche Elisabeth Hermansson, Alvangen; Lennart Andersson, Partille; Magnus Linsten, Kungaly; Jiri Basta, Partille; Lillemor Holtinger, Nödinge, all of (SE)

(73) Assignee: Eka Nobel AB, Stockholm (SE)

( * ) Notice: Subject to any disclaimer, the term of this patent is extended or adjusted under 35 U.S.C. 154(b) by 0 days.

(21) Appl. No.: 08/754,884

(22) Filed: Nov. 22, 1996

Related U.S. Application Data

(60) Division of application No. 08/389,630, filed on Feb. 15, 1995, now abandoned, which is a continuation of application No. 07/968,519, filed on Oct. 29, 1992, now abandoned, which is a continuation-in-part of application No. 07/875,130, filed on Apr. 28, 1992, now abandoned.

(30) Foreign Application Priority Data

Apr. 30, 1991 (SE) ..... 9101301

(51) Int. Cl.[7] ..... D21C 9/10; D21C 9/14; D21C 9/147; D21C 9/16

(52) U.S. Cl. ..... 162/65; 162/67; 162/76; 162/78; 162/82; 162/87; 162/80

(58) Field of Search ..... 162/65, 78, 76, 162/88, 89, 67, 82, 83, 84, 85, 87

(56) References Cited

U.S. PATENT DOCUMENTS

| | | | | |
|---|---|---|---|---|
| 2,687,943 | A | 8/1954 | Pete | 8/104 |
| 3,507,744 | A | 4/1970 | Grangaard | |
| 3,652,385 | A | 3/1972 | Noreus et al. | |
| 3,865,685 | A | 2/1975 | Hebbel et al. | |
| 4,222,819 | A | 9/1980 | Fossum et al. | |
| 4,619,733 | A | 10/1986 | Kooi | |
| 4,731,161 | A | 3/1988 | Ehrhardt | |
| 4,732,650 | A | 3/1988 | Michalowski et al. | |
| 4,834,837 | A | 5/1989 | Loquenz et al. | |
| 4,859,283 | A | 8/1989 | Jayawant | |
| 5,034,096 | A | 7/1991 | Hammer et al. | |
| 5,143,581 | A | 9/1992 | Devic | |

FOREIGN PATENT DOCUMENTS

| | | |
|---|---|---|
| AU | A-26798/88 | 8/1989 |
| CA | 575636 | 5/1959 |
| CA | 1122358 | 4/1982 |
| CA | 1206704 | 7/1986 |
| EP | 0 402 335 | 12/1990 |
| EP | 0415149 | 3/1991 |
| EP | 0 511 695 | 11/1992 |
| JP | 75-137933 | 11/1975 |
| JP | 51-102103 | 9/1976 |
| JP | 52-63402 | 5/1977 |
| JP | 53-143704 | 12/1978 |
| JP | 54-55606 | 5/1979 |
| JP | 55-158394 | 12/1980 |
| JP | 57-21590 | 2/1982 |
| JP | 58-132190 | 8/1983 |
| JP | 2-145884 | 6/1990 |
| JP | 3-64589 | 3/1991 |
| WO | 79/00637 | 9/1979 |

OTHER PUBLICATIONS

Liebergott et al, "Bleaching of Softwood Kraft Pulp Without Chlorine Compounds", Tappi, Aug. 1984.*
English abstract of European Patent application No. EP 0 578 304.
Abstract for Japanese application No. 54055606.
R. P. Singh, Tappi Press, 3rd Ed., 1979, pp. 164–165 & 177–178, The Bleaching of Pulp.
JP–3064589, Derwent Publications Ltd., London, GB; Mitsubishi Gas Chem KK, Mar. 19, 1991.
Ruhanen et al, "First Stage Bleaching of Softwood Kraft Pulp With Peroxide, Instead of Chlorine", Tappi, J., Sep. 1982, p. 107–110.
J. P. Casey, "Pulp and Paper Chemistry and Chemical Technology", 3rd Edition, vol. 1, p. 651, 1980, John Wiley & Sons, New York, NY.
Lachenal et al., "Improvement of Ozone Prebleaching of Kraft Pulps", J. of Pulp and Paper Science, vol. 12, No. 2, Mar. 1986, p. J50–J53.
"Production of Bleached Chemical Pulp in the Future", vol. 3, Bleachability & Chlorine Free Bleaching of Sulfite Pulps Mill Experiences, SPCI, Sweden, Jun. 11, 1991.
J.L. Colodette et al., "Factors Affecting Hydrogen Peroxide Stability in the Brightening of Mechanical and Chemimechanical Pulps", J. of Pulp and Paper Science, vol. 15, No. 2, Mar. 1989, p. J45–J50.
A.F. Gilbert et al., Mechanism of Magnesium Retardation of Cellulose Degradation During Oxygen Bleaching, Tappi, Jun. 1973, vol. 56, No. 6, p. 95–99.
Abstract of Japanese application Nos. 52063402 and 75137933.
English translation of Japanese application No. 75137933.
Abstract of Japanese application No. 51102103.
Abstract of Japanese application No. 58132190.
Abstract of Japanese application No. 3064589.
Abstract of Japanese application No. 2145884.
Abstract of Japanese application No. 55158394.
Abstract of Japanese application No. 57021590.

* cited by examiner

*Primary Examiner*—Steve Alvo
(74) *Attorney, Agent, or Firm*—Burns, Doane, Swecker & Mathis, L.L.P.

(57) ABSTRACT

A process for delignification and bleaching of chemically digested lignocellulose-containing pulp. In a first embodiment, the pulp is acid treated at a pH of between about 1 and about 6, whereupon a water-soluble compound containing an alkaline earth metal is added at a pH of between about 1 and about 7 before the pulp is treated with a chlorine-free bleaching agent. In a second embodiment, the acid and alkaline earth metal treatments are carried out in a single step. The chlorine-free bleaching agent includes peroxide compounds, ozone, oxygen and sodium dithionite in an optional sequence or mixture. After the treatment according to the invention, the pulp may be finally bleached to the desired brightness, suitably with a chlorine-free bleaching agent, such as ozone, to completely avoid formation and discharge of AOX.

9 Claims, No Drawings

PROCESS FOR ACID BLEACHING OF LIGNOCELLULOSE-CONTAINING PULP WITH A MAGNESIUM COMPOUND

CROSS-REFERENCE TO RELATED APPLICATION

This application is a divisional, of application Ser.No. 08/389,630, filed Feb. 15. 1995, now abandoned, which is a continuation of application Ser. No. 07/968,519, filed Oct. 29. 1992, now abandoned, which is a continuation-in-part of application Ser. No. 07/875,130, filed Apr. 28, 1992, now abandoned.

BACKGROUND OF THE INVENTION

In the production of chemical pulp of high brightness, wood chips are first cooked to separate the cellulose fibers. Part of the lignin holding the fibers together is thus degraded and modified, such that it can be removed by subsequent washing. However, in order to obtain sufficient brightness, more lignin has to be removed, together with brightness-impairing (chromophoric) groups. This is frequently effected by delignification with oxygen, followed by bleaching in several stages.

For environmental reasons, it has become increasingly common to treat chemical pulp with chlorine-free bleaching agents already in the first bleaching steps. The big advantage is the drastic reduction in the discharges of chlorinated organic substances detrimental to the environment, owing to the combined effect of a smaller amount of chlorine-containing bleaching agents and lower content of lignin, which is the organic substance primarily reacting with the chlorine.

It is known to use chlorine-free bleaching agents, such as hydrogen peroxide, peracetic acid or ozone, already in the prebleaching. However, the delignification and consumption of the bleaching agent become less effective than with chlorine-containing bleaching agents, unless the pulp is pretreated. Thus, a hydrogen peroxide treatment in an alkaline environment is disturbed by the presence in the pulp of ions of certain metals, such as Mn, Cu and Fe. These metal ions cause degradation of hydrogen peroxide, thereby reducing the efficiency of the peroxide treatment and increasing the consumption of peroxide. According to CA 1,206,704, this can be counteracted by pretreating the pulp with an acid, such as sulfuric acid or nitric acid, whereby the concentration of all types of metal ions is reduced. However, by this treatment also metal ions, for example Mg, which are advantageous to the peroxide treatment disappear, which ions stabilize the peroxide and increase the selectivity of the peroxide.

CA 575,636 discloses the addition of magnesium sulphate to stabilize alkaline peroxide solutions. However, the addition is made directly to the bleaching liquor and in an alkaline environment insoluble magnesium hydroxide precipitates. Furthermore, U.S. Pat. No. 4,222,819 discloses the addition of magnesium ions to acidic peroxide solutions, but also in this case the addition is made directly to the bleaching liquor. None of the related methods makes possible diffusion of the magnesium ions into the pulp to such an extent that a pulp of high brightness and strength can be obtained.

SUMMARY OF THE INVENTION

The present invention relates to a process for delignification and bleaching of chemically digested lignocellulose-containing pulp. In a first embodiment, the pulp is acid treated at a pH of between about 1 and about 6, whereupon a water-soluble compound containing an alkaline earth metal is added at a pH of between about 1 and about 7 before the pulp is treated with a chlorine-free bleaching agent. The initial acidic treatment removes the trace metals of the pulp, whereas the subsequent addition of alkaline earth metal ions in aqueous solution returns the ions to the positions in the pulp where they have a particularly beneficial effect on the preservation of the cellulose chains and, consequently, on the viscosity, as well as on the consumption of bleaching agent in the subsequent bleaching step. In a second embodiment, the acid treatment step and the alkaline earth metal treatment steps are combined. The presence of the alkaline earth metal ions during the acid treatment results in a substantial portion of the original alkaline earth metal to be retained in the pulp.

After the treatment according to the invention, the pulp may be finally bleached to the desired brightness, suitably with a chlorine-free bleaching agent, such as ozone, to completely avoid formation and discharge of AOX. The final bleaching step is preferably carried out in the presence of an alkaline earth metal ion such as magnesium, calcium or barium.

DETAILED DESCRIPTION OF THE PREFERRED EMBODIMENTS

The invention provides a process in which lignocellulose-containing pulp is treated under the conditions disclosed in the claims, whereby the metal ions harmful to the subsequent bleaching are effectively removed and the profile of alkaline earth metals is either retained or restored before the pulp is bleached in a chlorine-free bleaching step.

In a first embodiment, the invention relates to a process for the bleaching of chemically digested lignocellulose-containing pulp, wherein the pulp is acid treated at a pH in the range from about 1 up to about 6, whereupon a compound containing an alkaline earth metal is added at a pH in the range from about 1 up to about 7 and in an amount of from about 0.01 kg, suitably 0.5 kg, up to about 10 kg/ton of dry pulp, calculated as alkaline earth metal, and that the pulp subsequently is treated with a chlorine-free bleaching agent, optionally in the presence of an alkaline earth metal ion such as magnesium, calcium or barium.

In a second embodiment, the steps of acid treatment and alkaline earth metal treatment are combined.

Acid treatment is an effective process to eliminate metal ions from lignocellulose-containing pulps. At the same time it is known that ions of alkaline earth metals, especially when in their original positions in the pulp, have a positive influence on the selectivity of the delignification as well as on the stability and consumption of chlorine-free bleaching agents, such as peroxides, ozone and oxygen.

In the first embodiment mentioned above, the process presents an economical solution to the problem of creating a suitable trace-metal profile for the subsequent chlorine-free bleaching in that non-desirable metal ions are eliminated while supplied ions of alkaline earth metals essentially recover the positions in the vicinity of the cellulose chains previously occupied by ions of alkaline earth metals. This is achieved by adding the compound containing an alkaline earth metal at such a pH and such a temperature that the compound is dissolved in water, thus enabling the diffusion required to obtain the intended effect. Furthermore, an advantage of this first embodiment is that the pH adjustment between the treatment with acid and addition of alkaline earth metal ions becomes very limited or may be left out altogether, which is advantageous to process technique and economy.

In the second embodiment, in which the steps of acid treatment and alkaline earth metal addition are combined, a similar result is achieved, with an important distinction.

While unwanted metal ions, such as manganese, iron and copper are removed by the acid, as in the first embodiment, the presence of alkaline earth metal ions in the acid treatment step is believed to create an equilibrium with similar ions in the wood pulp. The net effect is that at least a substantial portion of the original alkaline earth metal ions in the pulp are retained, that is, they are not removed by the acid treatment.

Because these original ions are left undisturbed during the acid treatment, they remain at their original locations in the cellulose chains and hence are believed to be somewhat more effective, or at least as effective, at preserving the cellulose chain compared to the replacement ions of the first embodiment. After the simultaneous treatment with acid and alkaline earth ions, the pulp is washed to remove the unwanted ions from the pulp suspension.

Chlorine-free bleaching agents include inorganic peroxide compounds, such as hydrogen peroxide and sodium peroxide, organic peroxide compounds, such as peracetic acid, as well as ozone, oxygen and sodium dithionite. Suitably, hydrogen peroxide (P), oxygen (O) and ozone (Z) are used in an optional sequence or mixture. Preferably, use is made of hydrogen peroxide or mixtures of hydrogen peroxide and oxygen (PO). The sequence P—Z or (PO)—Z are especially preferred.

Also preferred is the addition of alkaline earth metal ions to the bleaching step itself. Suitable ions are, again, magnesium, calcium and barium, with calcium being highly preferred. On a dry pulp basis, the amount of alkaline earth metal ion which can be added to the bleaching stage is generally between about 200 to about 4000 ppm, desirably between about 300 and about 3000 ppm and preferably between about 500 and about 2000 ppm.

In the treatment with a chlorine-free bleaching agent in an alkaline environment, pH is suitably adjusted by adding to the pulp an alkali or an alkali-containing liquid, such as sodium carbonate, sodium hydrogen carbonate, sodium hydroxide, oxidized white liquor or magnesium hydroxide slurry. Suitably, the magnesium hydroxide slurry is taken from the chemical handling system in the production of sulphite pulp with magnesium as base, i.e., magnefite pulp.

The acid treatment suitably is carried out with an acid. The acids used are inorganic acids, suitably sulfuric acid, nitric acid, hydrochloric acid or residual acid from a chlorine dioxide reactor, either separately or in an optional mixture. Preferably, sulfuric acid is employed.

Compounds containing an alkaline earth metal include water-soluble chemicals containing magnesium, calcium, barium or mixtures of such chemicals. Use is suitably made of magnesium-containing compounds, such as magnesium sulphate or magnesium chloride, or calcium-containing compounds, such as calcium chloride or calcium oxide. Use is preferably made of magnesium sulphate or magnesium chloride, the use of magnesium sulphate being especially preferred. The combination of temperature and pH at the addition of the compound containing an alkaline earth metal is always so chosen that the compound is in aqueous solution when contacted with the pulp.

In the first embodiment of the process according to the invention, the acid treatment is carried out at a pH of from about 1 up to about 6, suitably from 1.5 up to 5, preferably from 2 up to 4. It is especially preferred that the acid treatment is carried out at a pH of from 2 up to 3. When magnesium is the alkaline earth metal in the compound containing an alkaline earth metal, the addition is made at a pH in the range from about 1 up to about 7, suitably in the range from 2 up to 6, preferably in the range from 2 up to 4. It is especially preferred that the addition of magnesium is made at a pH of from 2 up to 3. When the chlorine-free bleaching agent is hydrogen peroxide, the pulp is suitably treated at a pH of from about 8 up to about 12, preferably at a pH of from 10 up to 12. Treatment with the other chlorine-free bleaching agents mentioned above, is carried out within the normal pH ranges for each bleaching agent, which are well-known to the person skilled in the art.

The treatment according to the first embodiment of the invention is preferably carried out with a washing step between the acid treatment and addition of alkaline earth metal ions, such that the trace metals that are harmful to the treatment with a chlorine-free bleaching agent are removed form the pulp suspension.

In the second embodiment of the invention, the pH of the acid is similar to that discussed above in connection with the first embodiment. Also in the second embodiment, a washing step is preferably carried out after the combined acid/alkaline earth metal treatment.

The realization of the acid treatment, a compound containing an alkaline earth metal and a chlorine-free bleaching agent, can be carried out at an optional position in the bleaching sequence, e.g. immediately after digestion of the pulp or after an oxygen step. The process according to the invention is preferably applied to pulp that has been delignified in an oxygen step prior to the treatment.

It is also within the scope of the invention that the pulp in the acid treatment also can be subjected to bleaching and/or delignifying treatment. Bleaching and/or delignifying chemicals active within the pH range suitable in the acid treatment are, e.g. chlorine dioxide, ozone, peracetic acid and/or an acid peroxide-containing compound. Suitably, a combination of acid treatment and bleaching and/or delignifying treatment takes place in an ozone step.

Lignocellulose-containing pulps relate to chemical pulps of softwood and/or hardwood digested according to the sulphite, sulphate, soda or organosolv process, or modifications and/or combinations thereof. Use is suitably made of softwood and/or hardwood digested according to the sulphate process, preferably sulphate pulp of hardwood.

The treatment according to the invention can be applied to lignocellulose-containing pulps having an initial kappa number within the range from about 5 up to about 40, suitably 7 up to 32, preferably from 10 up to 20. Here, the kappa number is determined according to the standard method SCAN-C 1:77.

In the process according to the invention, the acid treatment or combined acid and alkaline earth metal ion treatment is carried out at a temperature of from about 10 up to about 95° C., suitably from 20 up to 80° C. and preferably from 40 up to 80° C., and for a period of time of from about 1 up to about 120 min., suitably from 10 up to 120 min. and preferably 20 up to 40 min. The compound containing an alkaline earth metal is added at a temperature of from about 10 up to about 95° C., preferably from 40 up to 80° C., and for a period of time of from about 1 up to about 180 min., preferably from 20 up to 180 min. and preferably from 30 up to 120 min. When the chlorine-free bleaching agent is hydrogen peroxide, the pulp is treated at a temperature of from about 30 up to about 100° C., preferably from 60 up to 90° C., and for a period of time of from about 30 up to about 300 min., suitably from 60 up to 240 min. In the acid treatment and in though addition of alkaline earth metal ions, or in the combined treatment of the second embodiment, the pulp concentration may be from about 3 up to about 35% by weight, preferably from 3 up to 15% by weight. When the chlorine-free bleaching agent is hydrogen peroxide, the pulp concentration may be from about up to about 50% by weight, suitably from 3 up to 35% by weight and preferably from 10 up to 25% by weight. Treatment with the other chlorine-free bleaching agents mentioned above is carried out within the normal ranges of temperature, time and pulp concentration for each bleaching agent, which are well-known to the person skilled in the art.

The amount of compound containing an alkaline earth metal charged, lies in the range from about 0.01 up to about 10 kg/ton of dry pulp, calculated as alkaline earth metal, suitably in the range from 0.5 up to 5 kg/ton of dry pulp, calculated as alkaline earth metal, and preferably in the range from 2 up to 4 kg/ton of dry pulp, calculated as alkaline earth metal.

The actual amount used is a function of the temperature, pH and residence time of alkaline earth metal ion solution (either alone or with the acid). These three variables, together with the alkaline earth metal ion concentration, are sufficient to provide, in the case of magnesium, at least 50% of the original ion amount in the pulp, desirably about 100% and preferably up to 130% of the original magnesium in the pulp.

In the case of calcium, the conditions of treatment should be such that at least 30% of the original calcium ions are returned or replaced, desirably about 70% and preferably about 90%. The inventors have found that a level of above 90% calcium, while useful, generally cannot be achieved.

For calcium, the above levels may be achieved through either treatment prior to final bleaching or by addition of calcium in the final bleaching stage. The levels mentioned for magnesium should be achieved at least in the treatment step prior to final bleaching.

It is also noted that the same or different alkaline earth metal ion can be used prior to final bleaching and in the final bleaching stage.

In preferred embodiments employing hydrogen peroxide as the chlorine-free bleaching agent, the amount of hydrogen peroxide lies in the range from about 2 up to about 50 kg/ton of dry pulp, calculated as 100% hydrogen peroxide. The upper limit is not critical, but has been set for reasons of economy. The amount of hydrogen peroxide suitably lies in the range from 3 up to 30 kg/ton of dry pulp and preferably from 4 up to 20 kg/ton of dry pulp, calculated as 100% hydrogen peroxide.

After the acid treatment, a compound containing an alkaline earth metal and a chlorine-free bleaching agent, the pulp can be used for direct production of paper with a lower demand for brightness. Alternatively, the pulp may be finally bleached to the desired higher brightness by treatment in one or more steps. Suitably, the final bleaching is also carried out with chlorine-free bleaching agents of the type mentioned above, optionally with intermediate alkaline extraction steps, which may be reinforced with peroxide and/or oxygen. In this way, the formation and discharge of AOX is completely eliminated. Suitably, the final bleaching is carried out with ozone in one or more steps. By the treatment according to the invention, the lignin content has been reduced to a sufficiently low level before any chlorine-containing bleaching agents are used. Therefore, chlorine dioxide and/or hypochlorite may well be used in one or more final bleaching steps without causing formation of large amounts of AOX.

Moreover, use of the process according to the invention means that the brightness and kappa number of the resulting pulp is higher and lower, respectively, than with the processes in which a compound containing an alkaline earth metal is not added at all or is added at a higher pH. In a process for bleaching chemical pulps, the aim is a high brightness as well s a low kappa number, the latter meaning a low content of undissolved lignin. At the same time, the consumption of the chlorine-free bleaching agent should be as low as possible meaning lower treatment costs. In the process according to the invention, these objects are met, as is apparent from the Examples. Furthermore, the strength of the pulp, measured as viscosity, is sufficient, which means that the pulp contains cellulose chains which are long enough to give a strong product. The process of the invention is advantageously used in bleaching of either chemical or mechanical pulps.

The invention and its advantages are illustrated in more detail by the Examples below which, however, are only intended to illustrate the invention and are not intended to limit the same. The percentages and parts stated in the description, claims and examples, refer to percent by weight and parts by weight, respectively, unless anything else is stated.

Examples 1–4 relate to the first embodiment of the invention, while Example 5 relates to the second embodiment.

EXAMPLE 1

According to the first embodiment of the invention, sulphate pulp of softwood having a kappa number of 17, a brightness of 35% ISO and a viscosity of 970 $dm^3$/kg was treated with sulfuric acid at a pH of 2.0. The pulp was treated at a temperature of 60° C. for 30 min., the pulp concentration being 10% by weight. After washing the pulp with water, magnesium was added in the form of an aqueous solution containing $MgSo_4$, to give a concentration of magnesium in the pulp of at least 500 pp. In the tests, the pH at the time of the addition was varied between 2.3 and 11.5 by addition of sulfuric acid. Then, the pulp was bleached with hydrogen peroxide at a temperature of 90° C., the residence time and pulp concentration being 180 min., and 15% by weight, respectively. The final pH was 11.5, and the addition of hydrogen peroxide was 15 kg/ton of dry pulp, calculated as 100% hydrogen peroxide. For comparative purposes, magnesium was added directly to the hydrogen peroxide step under the conditions stated above, in accordance with the prior art. To provide a further comparison, the pulp was also treated with only sulfuric acid and hydrogen peroxide under the conditions stated above. The kappa number, viscosity and brightness of the pulp were determined according to SCAN Standard Methods, and the consumption of hydrogen peroxide was determined by iodometric titration. The test results appear from the Table below.

TABLE I

| Ph at the addition of Mg | Kappa number step 2 | Viscosity step 2 ($dm^3$/kg) | Brightness step 2 (% ISO) | Residual $H_2O$ step 2 (kg/ton) |
|---|---|---|---|---|
| 2.3 | 9.1 | 903 | 61.0 | 1.5 |
| 4.7 | 9.2 | 910 | 60.0 | 1.0 |
| 9.5 | 9.8 | 930 | 56.1 | 0.9 |
| 11.5 | 10.0 | 940 | 52.2 | 0.2 |

TABLE I-continued

| Ph at the addition of Mg | Kappa number step 2 | Viscosity step 2 ($dm^3$/kg) | Brightness step 2 (% ISO) | Residual $H_2O$ step 2 (kg/ton) |
|---|---|---|---|---|
| —* | 9.8 | 890 | 54.1 | 0.5 |
| 2.3** | 9.9 | 875 | 48.2 | 0.0 |

*Magnesium added directly to the alkaline hydrogen peroxide step.
**No magnesium added.

As is apparent from the Table, the treatment according to the present invention with $MgSO_4$ at a pH in the range from about 2 up to about 6 is essential to give maximum increase in brightness and maximum reduction of the kappa number,r as well as minimum decrease in viscosity and minimum consumption of hydrogen peroxide. Furthermore, the importance of the magnesium ions for the increase in brightness appears from the comparison at a pH of 2.3, where, in the final test, the peroxide treatment was preceded only by acidic treatment.

EXAMPLE 2

Oxygen-delignified sulphate pulp of softwood having a kappa number of 13.7, a brightness of 37.1% ISO and a viscosity of 1057 $dm^3$/kg, was treated in a first step with 15 kg of sulfuric acid/ton of dry pulp at a pH of 1.9. The pulp ws treated at a temperature of 50° C. for 60 min., the pulp concentration being 10% by weight. After washing the pulp with water, in a second step between 0.1 and 1.5 kg of magnesium/ton of dry pulp was added in the form of an aqueous solution containing $MgSO_4$. Magnesium was added at a pH of 4.1, a temperature of 50° C. for 60 min. and with a pulp concentration of 3.5% by weight. Then, the pulp ws bleached with hydrogen peroxide at a temperature of 90° C., the residence time and pulp concentration being 240 min. and 10% by weight, respectively. The final pH was 11.5 and the addition of hydrogen peroxide was 20 kg/ton of dry pulp calculated as 100% hydrogen peroxide. For comparative purposes, the pulp was also treated with only sulfuric acid and hydrogen peroxide under the conditions stated above. The kappa number, viscosity and brightness were determined according to SCAN Standard Methods. The results after bleaching with hydrogen peroxide appear from the Table below.

TABLE II

| Amount of Mg added in step 2 (kg/ton) | Amount of Mg in pulp after step 2 (ppm) | Kappa number Step 3 | Viscosity Step 3 ($dm^3$/kg) | Brightness step 3 (% ISO) |
|---|---|---|---|---|
| 0 | 3.7 | 9.6 | 900 | 51.5 |
| 0.1 | 130 | 8.2 | 870 | 61.8 |
| 0.3 | 250 | 7.8 | 864 | 65.1 |
| 0.75 | 370 | 7.7 | 855 | 65.9 |
| 1.5 | 480 | 7.6 | 845 | 67.3 |

As is apparent from the Table, acid treatment followed by addition of dissolved magnesium and bleaching with hydrogen peroxide according to the present invention, positively influence the pulp as regards kappa number, viscosity and brightness.

EXAMPLE 3

The oxygen-delignified sulphate pulp of softwood used in Example 2, was treated in the sequences D-EOP-Z-P (test 1) and D-EOP-Z-Mg-P (test 2), where the conditions in each step were equal in both sequences. D and EOP relate to a conventional chlorine dioxide step and a conventional alkaline extractions step reinforced with hydrogen peroxide and oxygen, respectively. Z relates to an ozone step with a pH of 2.3. Mg relates to the addition of 1 kg of magnesium/ton of dry pulp, in the form of an aqueous solution containing $MgSO_4$. Magnesium was added at a pH of 4.1, a temperature of 50° C. for 30 min., the pulp concentration being about 3% by weight. P relates to a hydrogen peroxide step, where the pulp ws treated at a temperature of 80° C. for 120 min. The final pH was about 11.5 and the addition of hydrogen peroxide was 5 kg/ton of dry pulp calculated as 100% hydrogen peroxide. The viscosity and brightness were determined according to SCAN Standard Methods. The results after bleaching with hydrogen peroxide appear from the Table below.

TABLE III

| Test | Amount of Mg added (kg/ton) | Amount of Mg in pulp after addition (ppm) | Viscosity ($dm^3$/kg) | Brightness (% ISO) |
|---|---|---|---|---|
| 1 | 0 | 16 | 820 | 86.3 |
| 2 | 1.0 | 255 | 872 | 88.4 |

As is apparent from the Table, addition of dissolved magnesium after an initial acid treatment with ozone and bleaching with hydrogen peroxide according to the present invention positively influence the pulp as regards viscosity and brightness.

EXAMPLE 4

The oxygen-delignified sulphate pulp of softwood used in Example 2 was treated win the sequences Step 1-$P_1$-Z-$P_2$ (test 1) and Step 1-$P_1$-Z-Mg-$P_2$ (test 2), where the conditions in each step were equal in both sequences. Step 1 relates to treatment with EDTA at a pH of 5. Z relates to an ozone step with a pH of 2.3, the pulp concentration being 10% by weight. Mg relates to the addition of 1 kg of magnesium/ton of dry pulp, in the form of an aqueous solution containing $MgSO_4$. Magnesium was added at a pH of 4.1, a temperature of 50° C. for 30 min., the pulp concentration being about 3% by weight. $P_2$ relates to a hydrogen peroxide step, where the pulp was treated at a temperature of 80° C. for 120 min. The final pH was about 11.5 and the addition of hydrogen peroxide was 5 kg/ton of dry pulp calculated as 100% hydrogen peroxide. For comparative purposes, the pulp was also treated in the sequence Step 1-$P_1$-Z-(PMg) (test 3). (PMg) relates to the addition of magnesium in the second alkaline hydrogen peroxide step under the conditions stated above, in accordance with the prior art. The viscosity and brightness were determined according to SCAN Standard Methods, and the consumption of hydrogen peroxide was determined by iodometric titration. The results after the second hydrogen peroxide step appear from the Table below.

TABLE IV

| Test | Amount of Mg added (kg/ton) | Amount of Mg in pulp (ppm) | Viscosity ($dm^3$/kg) | Bright-ness (% ISO) | $H_2O_2$ con-sumed in $P_2$ (% added) |
|---|---|---|---|---|---|
| 1 | 0 | 9 | 794 | 80.9 | 76 |
| 2 | 1.0 | 300 | 856 | 83.9 | 28 |
| 3 | 1.0 | 120 | 809 | 81.6 | 60 |

As is apparent from the Table, addition of magnesium within the present pH range before bleaching with hydrogen peroxide positively influences the pulp as regards viscosity and brightness and reduces the consumption of hydrogen peroxide.

EXAMPLE 5

An oxygen predelignified sulfate pulp of softwood was treated in accordance with the second embodiment of the invention including an intermediate wash (test 2). Before treatment, the kappa number was 18, brightness 34.2% ISO and viscosity 1000 dm/kg. In the pretreatment step, the pulp was treated at a pH of 2–3 in the presence of magnesium at a charge of 1000 ppm. The pulp was then washed with a washing liquor. The pH of the washing liquor was about 5. Finally the pretreated and washed pulp was bleached with hydrogen peroxide at a temperature of 90° C., for 4 hours. The charge was 25 kg of hydrogen peroxide per ton of dry pulp and the final pH about 11. For comparison, the pulp was also treated according to the first embodiment with an intermediate wash (test 1). In test 1, the pH of the acid wash was 2 and the pH when adding magnesium 4–5. The remaining conditions were similar to the ones in test 2. The pulp properties after treatment according to the first and second embodiments are set forth in the Table below.

TABLE V

Pulp properties after peroxide bleaching

| Test | Kappa Number | Viscosity ($dm^3/kg$) | Bright-ness (% ISO) | Residual $H_2O_2$ (kg/ton) |
|---|---|---|---|---|
| 1 (First embodiment) | 9.0 | 810 | 63.2 | 0 |
| 2 (Second embodiment) | 9.0 | 830 | 63.4 | 0 |

As can be seen from TABLE V, the results using the second embodiment are similar or slightly improved compared to the first embodiment.

What is claimed is:

1. A process for delignification and bleaching of a chemically digested lignocellulose-containing pulp, wherein the pulp is bleached at a pH in the range from about 1 up to about 6 with a bleaching chemical selected from the group consisting of chlorine dioxide, ozone, peracetic acid and acid peroxides, whereupon a water-soluble chemical containing magnesium is added at a pH in the range from about 1 up to about 7 and in an amount of from about 0.01 up to about 10 kg/ton of dry pulp, calculated as magnesium, and that subsequently the pulp is bleached with hydrogen peroxide at a pH of from about 8 up to about 12.

2. A process according to claim 1, wherein the amount of hydrogen peroxide is at least 4 kg/ton dry pulp.

3. A process according to claim 1, wherein the chemically digested pulp is a sulphate pulp.

4. A process according to claim 1, wherein the water-soluble chemical containing magnesium is added at a pH of from 2 up to 6.

5. A process according to claim 1, wherein the water-soluble chemical containing magnesium consists of magnesium sulphate or magnesium chloride.

6. A process according to claim 1, wherein the pulp is washed after the acid bleaching.

7. A process according to claim 1, wherein the bleaching before addition of the water-soluble chemical containing magnesium is carried out at a pH in the range from 1.5 up to 5.

8. A process according to claim 1, wherein the pulp, after the bleaching with hydrogen peroxide, is finally bleached with ozone in one or more steps.

9. A process according to claim 1, wherein the acid bleaching step is carried out at a temperature of from about 10° C. up to about 95° C. for about 1 min up to about 120 min, the water-soluble chemical containing magnesium is added at a temperature of from about 10° C. up to 95° C. for about 1 min up to about 180 min and in an amount of from 0.5 up to 5 kg/ton of dry pulp, calculated as magnesium, the treated pulp having a pulp concentration of from about 3 up to about 35% by weight.

* * * * *